US006135764A

United States Patent [19]

Kwiatek

[11] Patent Number: 6,135,764

[45] Date of Patent: Oct. 24, 2000

[54] RIBBON PORT BURNER FOR GAS RANGE

[76] Inventor: David J. Kwiatek, 1101 S. Stone Ave., LaGrange, Ill. 60525

[21] Appl. No.: 09/057,926

[22] Filed: Apr. 9, 1998

[51] Int. Cl.[7] ..... F23Q 3/00; F24C 3/00

[52] U.S. Cl. ..... 431/266; 431/263; 126/39 H; 126/39 E; 239/567

[58] Field of Search ..... 431/266, 263, 431/258, 349; 126/39 H, 39 E, 39 R, 41 R; 239/552, 567

[56] References Cited

U.S. PATENT DOCUMENTS

| | | | |
|---|---|---|---|
| 746,992 | 12/1903 | Rice | 239/567 |
| 1,158,986 | 11/1915 | Cronwall | 126/39 H |
| 1,480,944 | 1/1924 | Morgan | 126/39 H |
| 3,213,920 | 10/1965 | Hoff | 158/116 |
| 3,809,055 | 5/1974 | Craver | 126/39 H |
| 3,817,689 | 6/1974 | Capy | 431/349 |
| 4,757,801 | 7/1988 | Le Monnier De Gouville et al. | 126/39 H |
| 4,891,006 | 1/1990 | Le Monnier De Gouville et al. | 126/39 H |
| 5,133,658 | 7/1992 | Le Monnier De Gouville et al. | 431/349 |
| 5,246,365 | 9/1993 | Himmel et al. | 126/39 H |
| 5,328,358 | 7/1994 | Riehl | 431/266 |
| 5,342,192 | 8/1994 | Hirano | 126/39 H |
| 5,443,380 | 8/1995 | Riehl | 431/266 |
| 5,464,345 | 11/1995 | Kwiatek | 431/266 |
| 5,468,145 | 11/1995 | Ferlin | 126/39 H |
| 5,490,778 | 2/1996 | Meijer | 431/349 |
| 5,492,469 | 2/1996 | Oda et al. | 431/266 |
| 5,800,159 | 9/1998 | Maughan et al. | 431/349 |

FOREIGN PATENT DOCUMENTS

| | | | |
|---|---|---|---|
| 1378995 | 10/1963 | France | 431/349 |

*Primary Examiner*—Ira S. Lazarus
*Assistant Examiner*—David Lee
*Attorney, Agent, or Firm*—Terrence Martin, Esq.; Sean Detweiler, Esq.; Jules Jay Morris, Esq.

[57] ABSTRACT

A ribbon port burner for a gas range comprises a base defining a gas inlet portion and a gas plenum portion. The gas plenum is defined by a bottom wall portion which terminates at its outer periphery in generally vertical outer side walls. The burner also includes a cap which is positioned in fixed spaced relation to the bottom wall such that the cap forms an upper wall of gas plenum portion. In this position the cap's relation to the side walls defines a ribbon port of essentially constant cross-sectional area continuously around the periphery of the burner. The burner also includes an ignition port in the bottom wall for accommodating insertion of an ignition system within the plenum. Preferably, a gas ignition portion is defined within the gas plenum portion defining a segregated volume. The burner side walls terminate in an acutely angled surface, as does the outer portion of the lower surface of the cap, such that an essentially constant cross sectional area is maintained to form the ribbon port. The base may also include a central chimney which mates with a like chimney in the cap to form an isolated central passage through plenum portion.

19 Claims, 5 Drawing Sheets

RIBBON PORT BURNER FOR GAS RANGE

FIELD OF THE INVENTION

The instant invention relates to consumer appliances, and more particularly to consumer gas ranges and surface burners for use therewith.

BACKGROUND OF THE INVENTION

A consumer gas range typically includes, in addition an oven compartment and possibly a boiler compartment, surface gas burners to allow cooking on the range top. Conventionally, these surface burners are controlled by a twist type valve which regulates the amount of gas which is delivered to the burner, and hence the size of the resulting flame. Once the gas has been delivered to the burner, it exits, in a conventional type burner, through multiple ports around the outer periphery of the burner. This gas is then ignited to form a plurality of flames which are used to heat the bottom surface of the pot or pan placed on the grate above the burner.

The construction of one of these conventional burners includes a burner base having a plurality of upwardly projecting salients. A burner cap, which may also include a plurality of downwardly projecting salients which mesh with the upwardly projecting salients of the burner base, is placed on the base to form a plurality of gas outlet ports through which the gaseous fuel exits. As described above, this gas is ignited, resulting in the cooking flame. Alternatively, the burner cap may not include downwardly projecting salients, and instead may simply be set on the uppermost horizontal surfaces of the base salients, forming the uppermost wall for the plurality of outlet ports.

Regardless of the particular construction of the conventional multiple port burner for a gas range, the design and manufacture of these multiple port burners carry with it a high manufacturing cost. This is the result of the manufacturing requirements for forming a plurality of upwardly projecting salients for the burner base, and possibly the formation of a plurality of downwardly projecting salients for the burner cap. Alternatively, if either the burner base or the burner cap is utilized to form the entire port, the associated manufacturing cost of forming these ports within the outwardly peripheral wall of either the base or the cap is also prohibitively high.

Additionally, these plurality of outlet ports may in fact reduce the useable life of the burner because of the reduced size and wall thickness of these elements. Furthermore, the use of such salients are subject to breakage during the manufacture, assembly, and use of the range which also potentially shortens the effective life of the burner. Moreover, the use of a plurality of flames reduces the efficiency of the burner by distributing the cooking flame to a plurality of discreet points on the cooking surface. Additionally, for designs which utilize either upwardly or downwardly projecting salients, user error in replacing the burner cap after cleaning to properly form the plurality of outlet ports may contribute to increased risk of accident in the home.

One method of overcoming the efficiency problem of heating in a point-wise fashion with a conventional multi port burner, is to utilize a burner which produces a ribbon type continuous flame around the outer periphery of the burner cap. This single continuous flame provides a more efficient delivery of flame to the cooking surface in a continuous, not point-wise, fashion. One such burner design producing a ribbon type flame is described in U.S. Pat. No. 3,213,920 issued to Hoff on Oct. 26, 1965, for a GAS BURNER. This patent describes the design of a gas burner having a frusto-conical shape outer wall. A cylindrical sleeve is removably positioned within the frusto-conical outer wall to form an inner wall of the burner. Gas is delivered to this area between the frusto-conical outer wall in the removably seated cylindrical sleeve and flows to the reduced end of the outer wall through a narrow exit passage formed between the termination of this outer wall and the removably placed cylindrical sleeve.

This exit passage forms a continuous opening around the periphery of the burner. The top of the removable sleeve includes a deflector section having stepped horizontal walls which serve to deflect the exiting gas outwardly prior to ignition. These stepped horizontal surfaces are positioned such that the continuous exit port around the periphery of the burner has an outwardly increasing cross-section as the gas moves in stepwise fashion from one horizontal wall to the next stepped change horizontal wall. This stepped change in the deflector section is described as being required to prevent flame lift during high gas flow rates, and to prevent flash-back during low gas flow rates.

While such a design is described as producing a ribbon type flame which overcomes the efficiency problems of a multi port gas burner, the particular design of the Hoff '920 patent would appear to suffer from high manufacturing costs, and possibly reduced reliability. Specifically, the cost of manufacturing such a burner including the specific geometry burner base, the removable sleeve, and the deflector cap attached to the top of the removable sleeve increases the cost of manufacture. Additionally, such a design requiring a specific geometry on the deflector cap defining varying cross-sections in relation to the burner base also increases the risk of accident if misplaced by a user after cleaning. Additionally, since the removable insert forms the inner wall, misplacement of this insert after cleaning may increase the risk of accident due to unintended flow of gas through openings within the inner wall caused by misplacement of the inner sleeve. Additionally, such a design requires external ignition of the flame because of the requirement for a very small inner platinum to control the rate of flow therethrough. Such a burner is not compatible with the new sealed hob burner environment used in the newest designs for consumer gas ranges.

SUMMARY OF THE INVENTION

In view of the above, it is therefore an object of the instant invention to overcome many of these and other known problems existing in the art. More specifically, it is an object of the instant invention to provide a new and improved gas burner for a consumer gas range capable of producing a continuous ribbon flame around its periphery. Additionally, it is an object of the instant invention to provide a new and improved ribbon port gas burner having reduced manufacture, assembly, and maintenance costs while increasing the efficiency and reliability of the burner. It is a further object of the instant invention to provide a gas burner for a consumer gas range suitable for use in a sealed hob gas range. It is a further object of the instant invention to provide a gas burner having a burner cap, the replacement of which on the burner base is substantially foolproof.

In view of the above it is a feature of the instant invention that the gas burner includes a burner base defining an interior plenum and including gap positioning studs for holding a burner cap in proper relation thereto to allow a continuous ribbon port area around the periphery of the burner base. It is a further feature of the instant invention to provide a burner for a consumer gas range having interior plenum gas ignition. It is also a feature of the instant invention to provide a burner cap having a continuous (non-stepped) surface forming, in conjunction with the burner base, the ribbon port gap.

In view of the above, a burner assembly comprises a base defining a gas inlet portion and a gas plenum portion, the gas plenum portion being defined by a generally horizontal bottom wall portion terminating at an outer periphery thereof in generally vertical outer side walls integrally formed therewith. The gas inlet portion defines a passage therein in gaseous communication with the gas plenum portion. The burner assembly further comprises a cap having an upper and a lower surface, and an outer periphery, and cap positioning elements positioned between the horizontal bottom wall and the lower surface of the cap for positioning the cap in fixed spaced relation to the horizontal bottom wall. As positioned, the cap forms an upper wall of the gas plenum portion, and, in relation to the vertical outer side walls, defines a ribbon port of essentially constant cross-sectional area continuously around the periphery.

The generally horizontal bottom wall further defines an ignition port for accommodating insertion of an ignition system within the plenum portion for igniting gas exiting through the ribbon port. The base further defines a gas ignition portion within the gas plenum portion having generally vertical walls which defines, in relation to a portion of the vertical outer side walls, a volume within the plenum. The generally vertical walls of the ignition portion define at least one slot or opening which allows gaseous communication with the plenum portion. The base of the burner assembly is generally circular and has a predefined radius. The cap is also generally circular and also has a predefined radius which exceeds the predefined radius of the base.

The vertical side walls of the base terminate in an acutely angled surface. The outer portion of the lower surface of the cap is also angled such that an essentially constant cross sectional area is maintained between the two when the cap is positioned by the cap positioning elements. In one embodiment, the gas inlet portion is positioned approximately equidistant from the generally vertical walls.

In an alternate embodiment, the burner assembly includes a central chimney extending from the bottom wall and defining a passage through it. In this embodiment the cap also includes a central chimney extending from the lower surface and defining a central passage. The central chimney of the cap mates with the central chimney of the base to form an isolated central passage through the plenum portion. The vertical side walls preferably have a width sufficient to form a ribbon port in relation to the cap of a length sufficient to prevent flame flash-back. Additionally, the width of the vertical side walls may be greater than that required to prevent flame flash-back, thereby forming a ribbon port in relation to the cap of a length sufficient to slow the rate of flow of gas through the ribbon port.

Alternatively, a surface burner for a gas range comprises a base integrally forming a gas inlet port, cap positioning elements, and a cup-like gas plenum portion. This gas plenum portion is defined by a generally horizontal circular bottom wall of a given radius terminating at an outer periphery thereof in a generally vertical continuous outer side wall which is integrally formed. A generally circular cap having a radius slightly larger than the radius of the bottom wall and having an upper and a lower surface is also included. Preferably, the cap is removably positioned by the cap positioning elements in spaced relation to the bottom wall forming an upper wall for the gas plenum portion, and in spaced relation to the generally vertical continuous outer side wall defining a ribbon port of essentially constant cross-sectional area continuously around the periphery.

The base further defines a gas ignition portion within the gas plenum portion. This ignition portion has generally vertical walls defining, in relation to a portion of the vertical continuous outer side wall, a segregated volume within the plenum portion. The generally vertical continuous outer side wall of the ignition portion defines at least one passage therethrough allowing gaseous communication from the plenum portion to the segregated volume. The generally horizontal bottom wall further defines an ignition port therein for accommodating insertion of an ignition device within the segregated volume for igniting gas therein.

The generally vertical continuous outer side wall of the base of the burner of the instant invention terminates in an outwardly upwardly angled surface. Additionally, at least an outer portion of the lower surface of the cap in spaced coincidence with the generally vertical continuous outer side wall is outwardly upwardly angled such that an essentially constant cross sectional area of the ribbon port defined therebetween is maintained. The generally horizontal circular bottom wall defines the gas inlet port in the center thereof in one embodiment of the instant invention.

In an alternate embodiment, the base further includes a central chimney extending from the bottom wall and defining a passage therethrough. The cap also includes a central chimney extending from the lower surface which defines a central passage therethrough, the central chimney of the cap mating with the central chimney of the base to form an isolated central passage through the plenum portion of the burner. Additionally, the generally vertical continuous outer side wall has a width such that the ribbon port formed in relation to the cap is of a length sufficient to prevent flame flash-back.

These and other aims, objectives, and features of the present invention will become more apparent from the following detailed description when taken in conjunction with the accompanying drawings.

DETAILED DESCRIPTION OF THE PREFERRED EMBODIMENT

Figure 1:
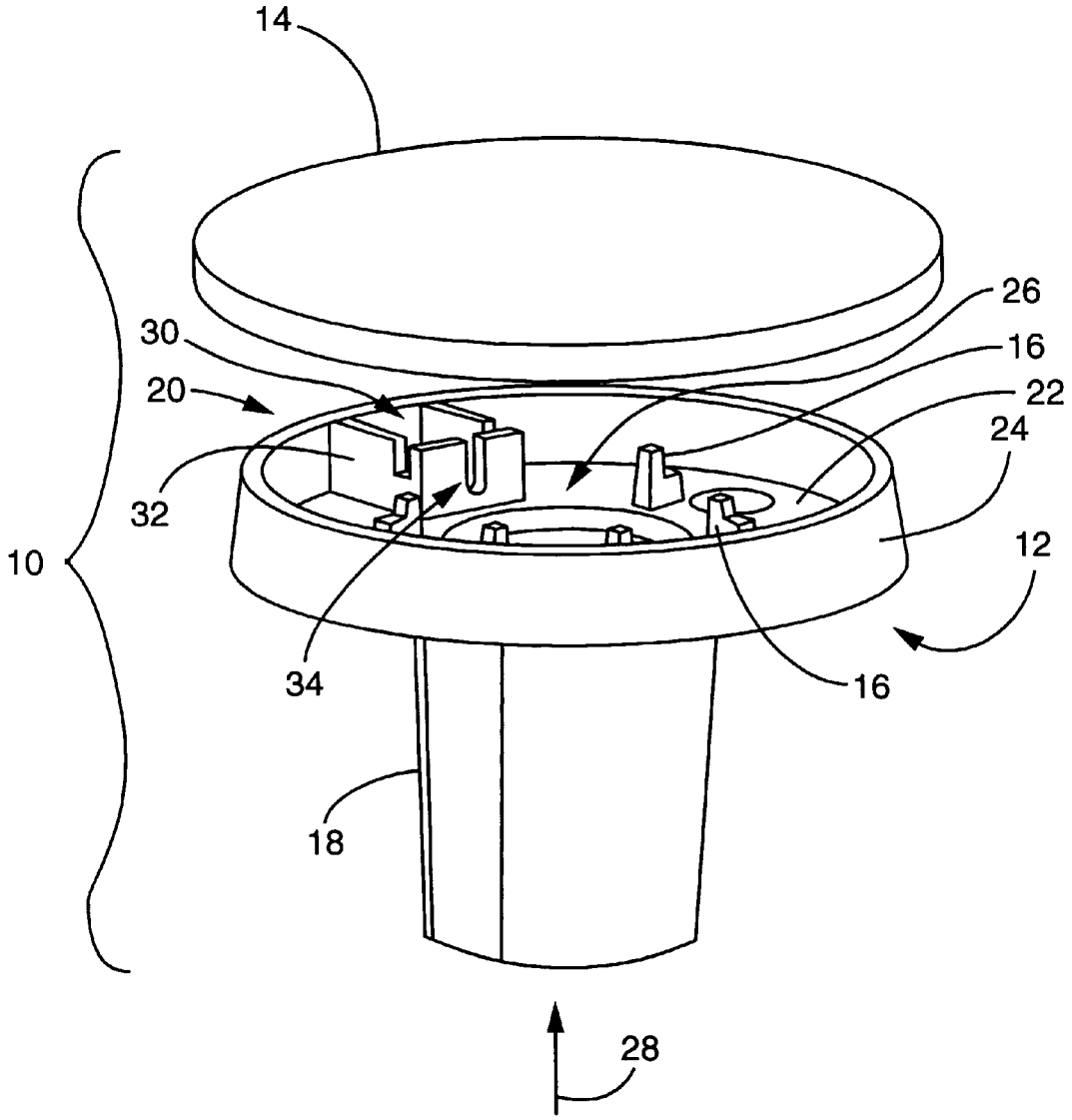
FIG. 1 is an expanded isometric view of a ribbon port burner constructed in accordance with an embodiment is of the instant invention.

In a preferred embodiment of the instant invention, as illustrated in FIG. 1, a burner assembly 10 comprises a base 12 and a cap 14 which is positioned in relation to the base 12 by cap positioning means, illustrated in FIG. 1 as cap positioning elements or studs 16. The base 12 preferably defines a gas inlet portion 18 and a gas plenum portion 20.

This gas plenum portion 20 is defined by a generally horizontal bottom wall 22 and the generally vertical outer side wall 24 which, in conjunction with the bottom wall 22, forms a cup-like gas plenum. In a preferred embodiment of the instant invention, the bottom wall 22 is generally circular in configuration.

In a preferred embodiment of the instant invention, the gas inlet portion 18 formed by the burner base 12 defines a passage 26 through which gaseous fuel is delivered into the plenum portion 20 of the burner assembly 10 as indicated by the directional flow arrow 28. This delivery of gaseous fuel may utilize mixer tubing or an in-shot style gas feed as desired. Once the gas has been delivered to the plenum area 20 a portion thereof will flow into a gas ignition portion 30 which is defined by vertical walls 32 in conjunction with side wall 24. These vertical walls 32 include at least one opening 34 to allow the gaseous fuel to flow from the plenum area to the gas ignition portion 30.

In a preferred embodiment of the instant invention, the above-described elements comprising the base 12 are all integrally formed during the base manufacture process. Such integral formation of this plurality of elements comprising the base 12 may be accomplished through conventional die casting, cold forming, metal impact, or other appropriate manufacturing techniques. The particular choice of manufacturing techniques forms no part of this invention and therefore should not be construed to limit the scope of the appended claims in any manner. Alternatively, the above described elements of the base portion 12 of the burner assembly 10 may be constructed from separate components and may not be integrally formed, although such may tend to increase the cost of manufacturing of the burner base.

Figure 2:
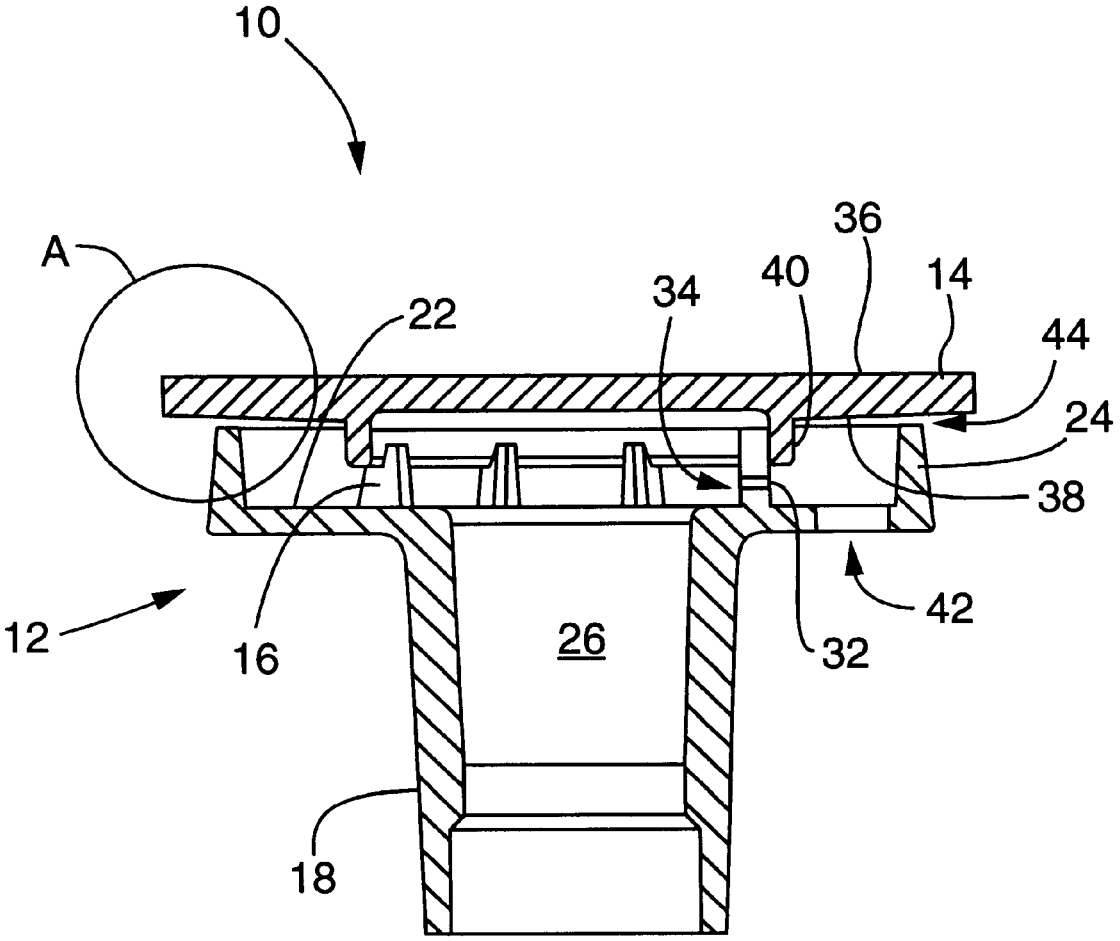
FIG. 2 is a cross-sectional illustration of an embodiment of the instant invention illustrated in FIG. 1.

Reference is now made to FIG. 2 which illustrates a completed burner assembly 10 in cross section in accordance with a preferred embodiment of the instant invention. Like numeric designations have been utilized to identify like elements. As may be seen from this cross sectional diagram of a preferred embodiment of the instant invention, the cap 14 includes an upper surface 36 and a lower surface 38. The cap may include a mounting flange 40 protruding from its lower surface 38 to be utilized in conjunction with the cap positioning elements 16 to maintain the cap in a removable fixed relationship with the burner base 12. Alternatively, the cap positioning elements may be extended to mate with the lower surface 38 of the cap 14 (see FIG. 5), thereby obviating the need for a mounting flange 40. However, as may be seen from this FIG. 2, the inclusion of a mounting flange 40 on the lower surface 38 of cap 14 allows for nearly foolproof positioning of the cap 14 in relation to the burner base 12.

As may be seen from this cross sectional view of a preferred embodiment of the instant invention, the burner base 12 also includes an ignition port 42 defined in the horizontal bottom 22 of base 12. This ignition port 42 is sized to accommodate the insertion of an ignition means within the plenum portion of the burner base 12 for igniting the gaseous fuel which will be exiting therefrom through the ribbon port 44. This ribbon port 44 is formed around the outer periphery of the burner by the spaced relation between the burner cap 14 and the vertical side walls 24, the details of which will be described more fully below with reference FIG. 3. The particular type of ignition means which is inserted through port 42 may include any appropriate means such as, for example, an electric spark ignition electrode. However, the particular type of ignition means utilized forms no part of the instant invention, and is provided as background information only, and shall not be viewed as a limitation on the instant invention as defined by the claims appended hereto Depending upon the type of ignition system utilized, however, the necessity for the ignition portion defined by vertical walls 32 may be obviated.

Figure 3:
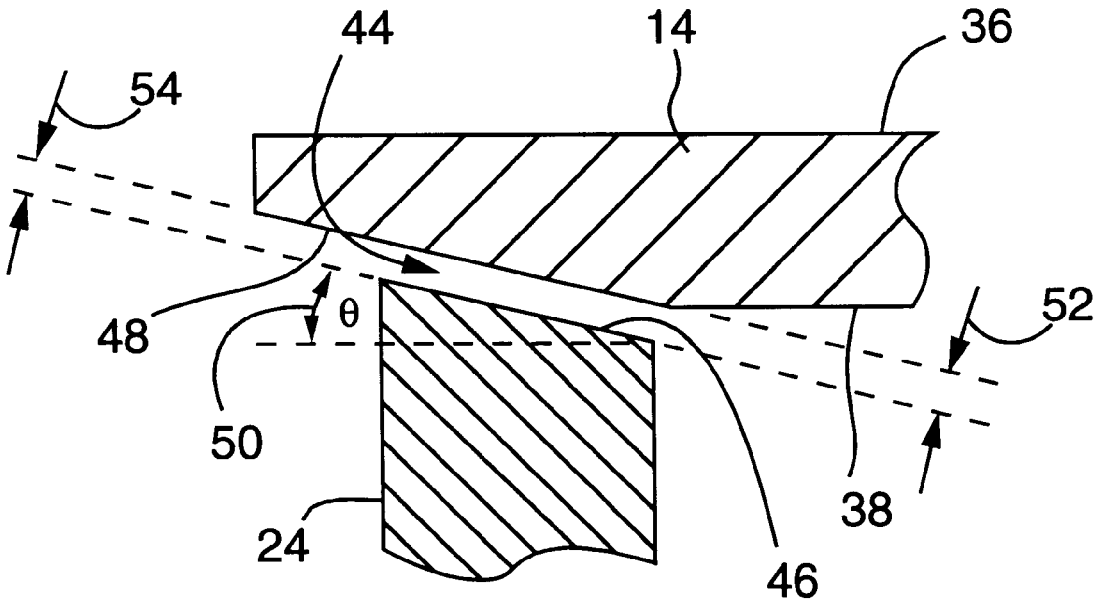
FIG. 3 is a partial cross-sectional view of the area designated by circle A of FIG. 2 illustrating an aspect of an embodiment of the instant invention.

The area of the assembly indicated by circle A in FIG. 2 is shown in greater detail in FIG. 3, and reference is now made thereto. As may be seen from this FIG. 3, the vertical side walls 24 of the base 12 terminate in an acutely angled surface 46. This surface is outwardly upwardly angled in relation to the horizontal plane oriented with the normal positioning orientation of the burner within a gas range. Likewise, the cap 14 also includes an outer angled portion 48 of the lower surface 38 which, in relation to the side walls 24, forms the gas outlet ribbon port 44. Preferably, each of these outwardly upwardly angled surfaces 46, 48 are continuous and angled at essentially the same angle 50 to form an essentially constant cross sectional area throughout the ribbon port 44, as indicated by the arrows 52 and 54. The degree of angle 50 may be any acute angle, but is preferably in the range of 10° to 45°, with a highly preferred range of 12° to 30°. Preferably, the width of the side walls 24, in relation to the cap 14 is at least equal to, but preferably greater than, that required to prevent flame flashback during operation of the burner as is known and recognized in the art. In a preferred embodiment of the instant invention, the length of the ribbon port 44 is sufficient to slow the rate of flow of gas there through during operation.

Figure 4:
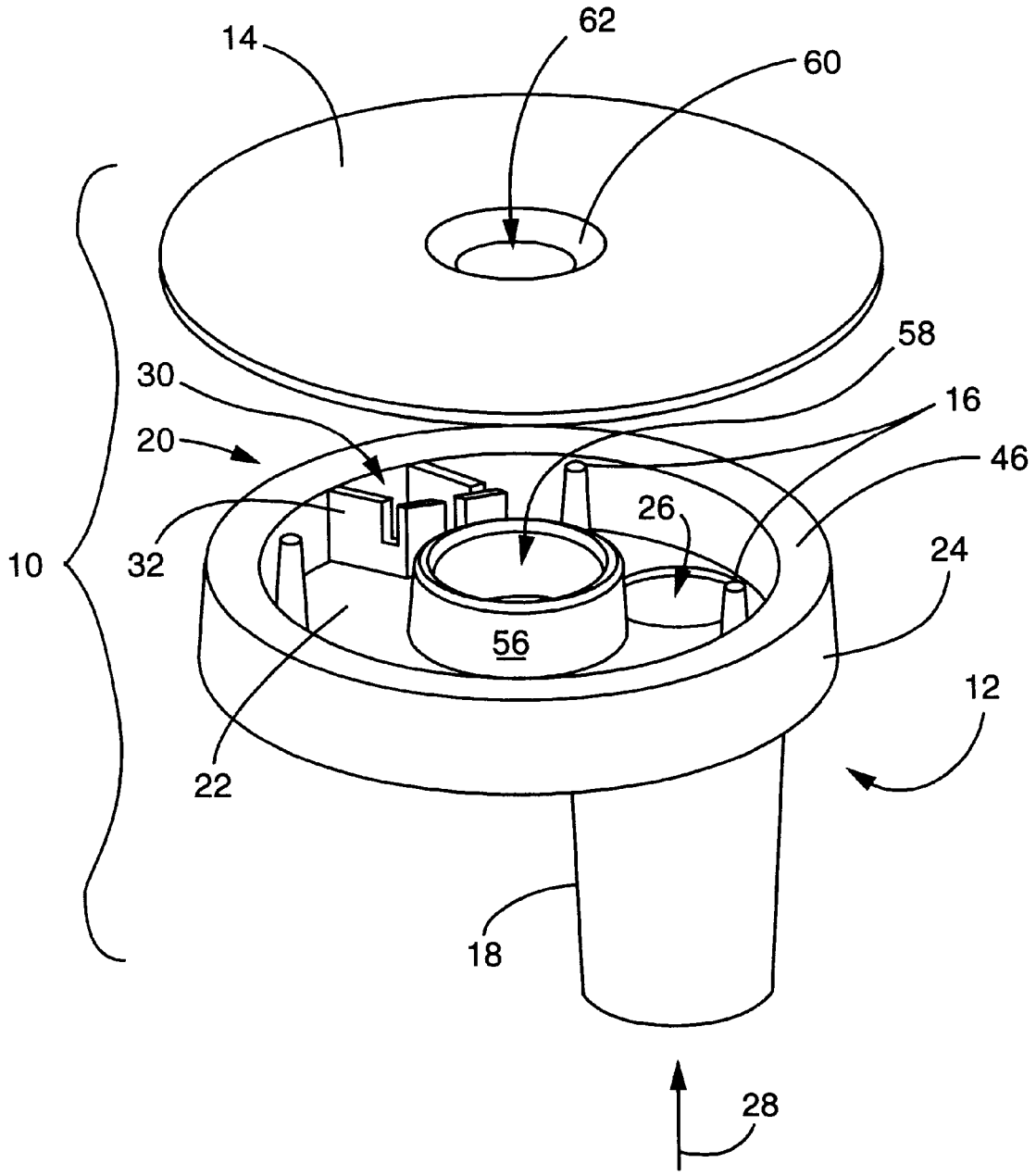
FIG. 4 is an exploded isometric view of a ribbon port burner constructed in accordance with an alternate embodiment of the instant invention.

An alternate embodiment of the instant invention is illustrated in FIG. 4, and reference is now made thereto. As with the above illustrations, like numerals are utilized to indicate like elements in this alternate embodiment of the instant invention. As with the embodiment of the instant invention illustrated in FIG. 1, this embodiment also includes a burner base 12 and a burner cap 14. The burner base comprises a gas inlet portion 18 and a gas plenum portion 20. In this embodiment of the invention, however, the gas inlet portion 18 is not centrally located with respect to the gas plenum portion 20, but instead has the gas inlet port 24 offset from center. This is as opposed to the embodiment of FIG. 1 which illustrated the gas inlet 24 being positioned approximately equidistant from the vertical walls 24. At this point it should be noted that both the burner base gas plenum portion 20 and the cap 14 are essentially circular in shape. As may be apparent from the various illustrations, the radius of the base 12 is smaller than the radius of the cap 14, allowing for a portion of the cap 14 to overhang the base 12.

With specific attention directed again to FIG. 4, it may be seen that in this alternate embodiment of the instant invention, the base 12 further includes a central chimney 56 extending from the bottom wall 22 and defining a passage 58 therethrough. Furthermore, in this alternate embodiment of the instant invention the cap 14 also includes a central chimney 60 extending from the lower surface and also defining a central passage 62 therethrough.

Figure 5:
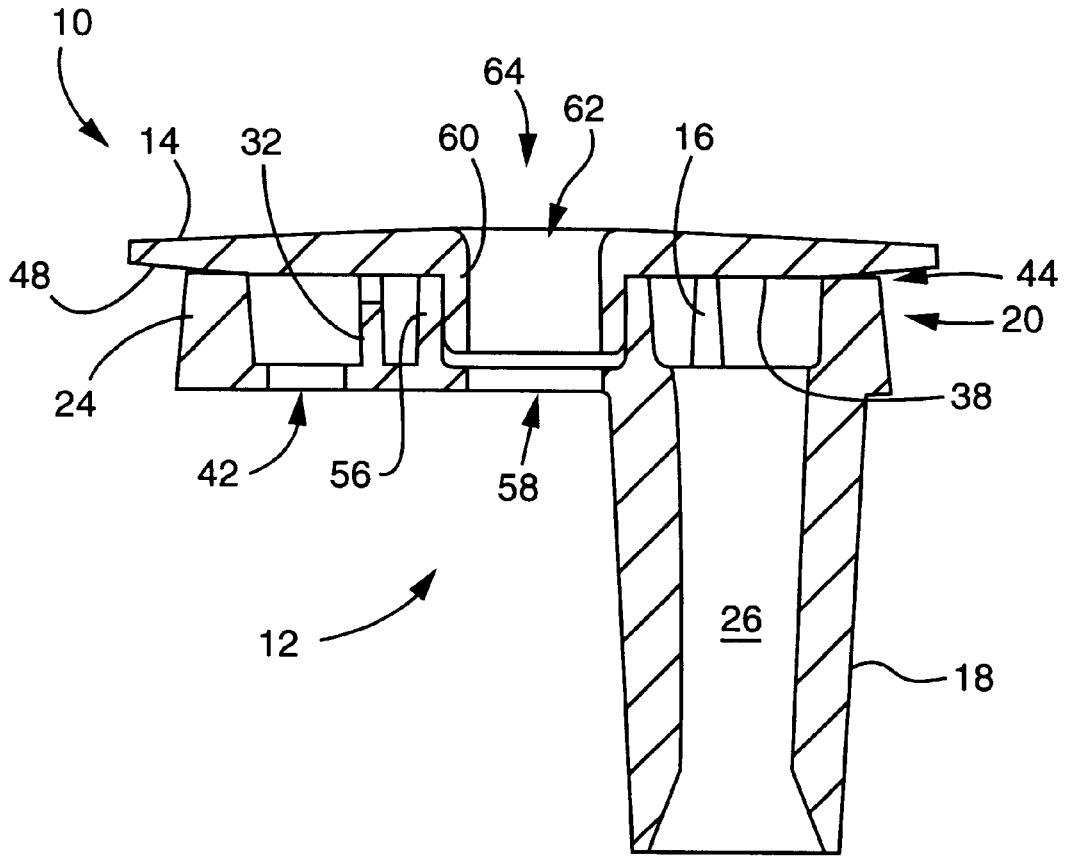
FIG. 5 is a cross-sectional view of the alternate embodiment of the instant invention illustrated in FIG. 4.

As is apparent from the cross sectional diagram of this alternate embodiment of the instant invention illustrated in FIG. 5, to which reference is now specifically made, the central chimney 60 of the cap 14 mates with the central chimney 56 with the base 12 to form an isolated central passage 64 completely through the plenum portion 20. This central passage 64 allows for the flow of secondary air through the plenum area to feed the backside of the flame produced by the combusting gas leaving the ribbon port 44. This passage 64 serves to improve the burner efficiency by providing a ready flow of air to the backside of the flames allowing complete combustion and continuous flame maintenance during the cooking process, especially where the flame is allowed to contact the bottom of the cooking vessel. This isolated central passage 64 also allows for the insertion therethrough of a cooking temperature or other probe to allow additional features and control to be added to the gas range. As may be seen from FIG. 5, the incorporation in this embodiment of the instant invention of central chimneys 56, 60 allow for simplification of the cap positioning elements 16 while still maintaining the essentially foolproof positioning of the cap 14 in relation to the plenum portion 20 of the base 12.

What is claimed is:

1. A burner assembly, comprising:

a base defining a gas inlet portion and a gas plenum portion, said gas plenum portion being defined by a generally horizontal bottom wall portion terminating at an outer periphery thereof in a generally vertical outer side wall integrally formed therewith, said gas inlet portion defining a passage therein in gaseous communication with said gas plenum portion;

a unitary cap having a generally horizontal top, a generally horizontal bottom surface, and an outer periphery; and cap positioning means positioned between said horizontal bottom wall and said generally horizontal bottom surface of said cap, the cap positioning means cooperating with said bottom wall to position said cap in fixed spaced relation to said horizontal bottom wall, said cap therein positioned forming an upper wall of said gas plenum portion, and in relation to said vertical outer side wall defining a ribbon port of essentially constant cross-sectional area continuously around said periphery therebetween, said ribbon port forming a primary gas discharge path for gas exiting therefrom.

2. A burner assembly, comprising:

a base defining a gas inlet portion and a gas plenum portion, said gas plenum portion being defined by a generally horizontal bottom wall portion terminating at an outer periphery thereof in a generally vertical outer side wall integrally formed therewith, said pas inlet portion defining a passage therein in gaseous communication with said gas plenum portion;

a cap having a generally horizontal top, a generally horizontal bottom surface, and an outer periphery;

a cap positioning means positioned between said horizontal bottom wall and said generally horizontal bottom surface of said cap for positioning said cap in fixed spaced relation to said horizontal bottom wall, said cap therein positioned forming an upper wall of said gas plenum portion, and in relation to said vertical outer side wall defining a ribbon port of essentially constant cross-sectional area continuously around said periphery therebetween; and said generally horizontal bottom wall further defines an ignition port therein for accommodating insertion of an ignition means within said plenum portion for igniting gas exiting therefrom through said ribbon port.

3. The burner assembly of claim 2, wherein said base further defines a gas ignition portion within said gas plenum portion, said ignition portion having generally vertical walls defining, in relation to a portion of said vertical outer side wall, a volume within said plenum, said generally vertical walls of said ignition portion defining at least one slot therein allowing gaseous communication with said plenum portion.

4. The burner assembly of claim 1, wherein said base is generally circular of a predefined radius, and wherein said cap is generally circular of a predefined radius which exceeds said predefined radius of said base.

5. The burner assembly of claim 4, wherein said vertical outer side wall of said base terminates in an acutely angled surface, and wherein an outer portion of said lower surface of said cap is angled such that an essentially constant cross sectional area is maintained therebetween.

6. The burner assembly of claim 1, wherein said gas inlet portion is positioned approximately equidistant from said generally vertical outer side wall.

7. A burner assembly, comprising:

a base defining a gas inlet portion and a gas plenum portion, said gas plenum portion being defined by a generally horizontal bottom wall portion terminating at an outer periphery thereof in a generaily vertical outer side wall integrally formed therewith, said gas inlet portion defining a passage therein in gaseous communication with said gas plenum portion;

a unitary cap having a generally horizontal top, a generally horizontal bottom surface, and an outer periphery;

cap positioning means positioned between said horizontal bottom wall and said generally horizontal bottom surface of said cap for positioning said cap in fixed spaced relation to said horizontal bottom wall, said cap therein positioned forming an upper wall of said gas plenum portion, and in relation to said vertical outer side wall defining a ribbon port of essentially constant cross-sectional area continuously around said periphery therebetween, said ribbon port forming a primary pas discharge path for gas exiting therefrom; and said base further includes a central chimney extending from said bottom wall and defining a passage therethrough.

8. A burner assembly, comprising:

a base defining a gas inlet portion and a gas plenum portion, said gas plenum portion being defined by a generally horizontal bottom wall portion terminating at an outer periphery thereof in a generally vertical outer side wall integrally formed therewith, said gas inlet portion defining a passage therein in gaseous communication with said gas plenum portion;

a cap having a generally horizontal top, a generally horizontal bottom surface, and an outer periphery;

cap positioning means positioned between said horizontal bottom wall and said generally horizontal bottom surface of said cap for positioning said cap in fixed spaced relation to said horizontal bottom wall, said cap therein positioned forming an upper wall of said gas plenum portion, and in relation to said vertical outer side wall defining a ribbon port of essentially constant cross-sectional area continuously around said periphery therebetween;

said base further includes a central chimney extending from said bottom wall and defining a passage therethrough; and said cap further includes a central chimney extending from said generally horizontal bottom surface and defining a central passage therethrough, said central chimney of said cap mating with said central chimney of said base to form an isolated central passage through said plenum portion.

9. The burner assembly of claim 1, wherein said vertical outer side wall has a width sufficient to form a ribbon port in relation to said cap of a length sufficient to prevent flame flash-back.

10. The burner assembly of claim 9, wherein said width of said vertical outer side wall is greater than that required to prevent flame flash-back, thereby forming a ribbon port in relation to said cap of a length sufficient to slow a rate of flow of gas therethrough.

11. A surface burner for a gas range, comprising:

a base having a gas inlet port and cap positioning elements integral therewith, and a cup-like gas plenum portion, said gas plenum portion being defined by a generally horizontal circular bottom wall of a given radius terminating at an outer periphery thereof in a generally vertical continuous outer side wall integrally formed therewith;

a generally circular unitary cap having a radius larger than said radius of said bottom wall, said cap having an a generally horizontal top and a generally horizontal bottom surface; and wherein said generally circular cap is removably positioned by said cap positioning elements in spaced relation to said bottom wall forming an upper wall for said gas plenum portion, and in spaced relation to said generally vertical continuous outer side wall defining a ribbon port of essentially constant cross-sectional area continuously around said periphery, said ribbon port being a primary gas discharge path for gas exiting therefrom.

12. A surface burner for a gas range, comprising:

a base having a gas inlet port and cap positioning elements integral therewith, and a cup-like gas plenum portion, said gas plenum portion being defined by a generally horizontal circular bottom wall of a given radius terminating at an outer periphery thereof in a generally vertical continuous outer side wall integrally formed therewith;

a generally circular cap having a radius larger than said radius of said bottom wall, said cap having an a generally horizontal top and a generally horizontal bottom surface;

said generally circular cap is removably positioned by said cap positioning elements in spaced relation to said bottom wall forming an upper wall for said gas plenum portion, and in spaced relation to said generally vertical continuous outer side wall defining a ribbon port of essentially constant cross-sectional area continuously around said periphery; and said base further defines a gas ignition portion within said gas plenum portion, said ignition portion having generally vertical walls defining, in relation to a portion of said vertical continuous outer side wall, a segregated volume within said plenum portion, said generally vertical continuous outer side wall of said ignition portion defining at least one passage therethrough allowing gaseous communication from said plenum portion to said segregated volume, and wherein said generally horizontal bottom wall further defines an ignition port therein for accommodating insertion of an ignition means within said segregated volume for igniting gas.

13. The burner assembly of claim 11, wherein said generally vertical continuous outer side wall having a width defining a top surface, said top surface defining an outwardly upwardly angled surface, and wherein at least an outer portion of said generally horizontal bottom surface of said cap in spaced coincidence with said generally vertical continuous outer side wall is outwardly upwardly angled such that an essentially constant cross sectional area of said ribbon port defined therebetween is maintained.

14. The burner assembly of claim 11, wherein said generally horizontal circular bottom wall defines said gas inlet port in the center thereof.

15. The burner assembly of claim 11, wherein said base further includes a central chimney extending from said bottom wall and defining a passage therethrough.

16. A surface burner for a gas range, comprising:

a base having a gas inlet port and cap positioning elements integral therewith, and a cup-like gas plenum portion, said gas plenum portion being defined by a generally horizontal circular bottom wall of a given radius terminating at an outer periphery thereof in a generally vertical continuous outer side wall integrally formed therewith;

a generally circular cap having a radius larger than said radius of said bottom wall, said cap having an a generally horizontal top and a generally horizontal bottom surface;

said generally circular cap is removably positioned by said cap positioning elements in spaced relation to said bottom wall forming an upper wall for said gas plenum portion, and in spaced relation to said generally vertical continuous outer side wall defining a ribbon port of essentially constant cross-sectional area continuously around said periphery;

said base further includes a central chimney extending from said bottom wall and defining a passage therethrough; and said cap further includes a central chimney extending from said lower surface and defining a central passage therethrough, said central chimney of said cap mating with said central chimney of said base to form an isolated central passage through said plenum portion.

17. The burner assembly of claim 11, wherein said generally vertical continuous outer side wall has a width such that said ribbon port formed in relation to said cap is of a length sufficient to prevent flame flash-back.

18. A burner for a gas range, comprising:

a base having cap positioning elements integral therewith, and a cup-like gas plenum portion, said gas plenum portion being defined by a generally horizontal circular bottom wall of a given radius terminating at an outer periphery thereof in a generally vertical continuous outer side wall integrally formed therewith and terminating in an outwardly upwardly angled surface, said generally horizontal circular bottom wall further defining a gas inlet port in the center thereof, said base further defining a gas ignition portion within said gas plenum portion, said ignition portion having generally vertical walls defining, in relation to a portion of said vertical continuous outer side wall, a segregated volume within said plenum portion, said generally vertical continuous outer side wall of said ignition portion defining at least one passage therethrough allowing gaseous communication from said plenum portion to said segregated volume, and wherein said generally horizontal bottom wall further defines an ignition port therein for accommodating insertion of an ignition means within said segregated volume for igniting gas therein;

a generally circular cap having a radius slightly larger than said radius of said bottom wall, said cap having a generally horizontal top and a generally horizontal bottom surface, said generally horizontal bottom surface having an outer portion which is outwardly upwardly angled; and wherein said cap is removably positioned by said cap positioning elements in spaced relation to said bottom wall forming an upper wall for said gas plenum portion, and in spaced relation to said generally vertical continuous outer side wall defining a ribbon port of essentially constant cross-sectional area continuously around said periphery.

19. A burner for a gas range, comprising:

a base having a gas inlet port and cap positioning elements intepral therewith, and a cup-like gas plenum portion, said gas plenum portion being defined by a generally horizontal circular bottom wall of a given radius terminating at an outer periphery thereof in a generally vertical continuous outer side wall integrally formed therewith and terminating in an outwardly upwardly angled surface, said base further including a central chimney extending from said bottom wall and defining a passage therethrough, said base further defining a gas ignition portion within said gas plenum portion, said ignition portion having generally vertical walls defining, in relation to a portion of said vertical continuous outer side wall, a segregated volume within said plenum portion, said generally vertical continuous outer side wall of said ignition portion defining at least one passage therethrough allowing gaseous communication from said plenum portion to said segregated volume, and wherein said generally horizontal bottom wall further defines an ignition port therein for accommodating insertion of an ignition means within said segregated volume for igniting gas;

a generally circular cap having a radius larger than said radius of said bottom wall, said cap having a generally horizontal top and a generally horizontal bottom surface, said generally horizontal bottom surface having an outer portion which is outwardly upwardly angled, said cap further defining a central chimney extending from said generally horizontal bottom surface and defining a central passage therethrough; and wherein said cap is removably positioned by said cap positioning elements in spaced relation to said bottom wall forming an upper wall for said gas plenum portion, and in spaced relation to said generally vertical continuous outer side wall defining a ribbon port of essentially constant cross-sectional area continuously around said periphery, said central chimney of said cap positioned in mating relation with said central chimney of said base to form an isolated central passage through said plenum portion.

* * * * *